US006006983A

United States Patent [19]

Grouwstra

[11] Patent Number: 6,006,983

[45] Date of Patent: Dec. 28, 1999

[54] BLANK FOR PRODUCING A CONTAINER AND A CONTAINER PRODUCED THEREFROM

[75] Inventor: Akko Grouwstra, Brummen, Netherlands

[73] Assignee: Nederlandse Pillo-Pak Maatschappij B.V., Eerbeek, Netherlands

[21] Appl. No.: 08/978,417

[22] Filed: Nov. 25, 1997

[51] Int. Cl.[6] ..... B65D 25/04

[52] U.S. Cl. ..... 229/120.14; 229/120.24; 206/561; 206/589

[58] Field of Search ..... 229/120.13, 120.14, 229/120.15, 120.24; 206/561, 565, 521.6, 588, 589

[56] References Cited

U.S. PATENT DOCUMENTS

| | | | |
|---|---|---|---|
| 1,922,571 | 8/1933 | Deline | 229/120.13 |
| 2,605,035 | 7/1952 | Williamson | 229/120.13 |
| 2,635,512 | 4/1953 | Harker . | |
| 2,690,866 | 10/1954 | Kirby . | |
| 2,717,116 | 9/1955 | Vines | 229/120.13 |
| 2,744,675 | 5/1956 | Crane . | |
| 4,347,969 | 9/1982 | Kost et al. . | |
| 4,489,879 | 12/1984 | Mode . | |

FOREIGN PATENT DOCUMENTS

| | | |
|---|---|---|
| 0 729 893 | 9/1996 | European Pat. Off. . |

*Primary Examiner*—Gregory M. Vidovich
*Assistant Examiner*—Tri M. Mai
*Attorney, Agent, or Firm*—Young & Thompson

[57] ABSTRACT

A blank for producing a finished container which is divided into compartments suitable for holding piece items. The blank comprises at least five rectangular panels which can be folded along fault lines to form the container having a bottom, a top, and sides. One of the rectangular panels which forms the top of the container comprises a plurality of folding lines, hexagonal fields, and at least one compartment partition. The fields are formed by a combination of slits and folding lines.

7 Claims, 5 Drawing Sheets

1
6
2
7
3
10
8
4
9
5
12
11
14
13
15
15a
16
17
18
19
20
21

BLANK FOR PRODUCING A CONTAINER AND A CONTAINER PRODUCED THEREFROM

FIELD OF THE INVENTION

The invention relates to a blank for producing a container which contains individual compartments. The individual compartments are used to hold piece contents. The blank as claimed in the invention is produced without scrap from web material. The blank has at least five rectangular plate parts which are joined by parallel longitudinal folding lines and which in the finished container form a bottom, a first side wall, a second side wall of the same width, and a plate part which yields a series of compartment partitions and which is located between the side walls. These plate parts have a number of transversely running sections and a number of transverse folding lines which run between the side longitudinal folding lines, and the side plates have folding lines which run obliquely from the intersection point of one longitudinal folding line with a transverse folding line to the outside to less than half the width of the side plates.

BACKGROUND OF THE INVENTION

Blanks of this type are known, for example, from U.S. Pat. Nos. 2,690,866 and 2,744,675 and from EP publication 0 729 983 A 2 of the applicant. By means of the embodiment known from EP 0 729 893 A 2, in a certain way the relative instability of containers produced from blanks as claimed in U.S. Pat. Nos. 2,690,866 and 2,744,675 were able to be improved; disruptive material scrap was also avoided in the embodiment as claimed in U.S. Pat. No. 2,744,675 as well. But it has been found in practice that the stability of these containers still leaves something to be desired, especially when relatively heavy contents are to be added and when the contents are present in a nonuniform shape with relatively large tolerances. These disadvantages occur especially when the blanks and containers consist of comparatively lighter material, for example, lightweight cardboard or lightweight one-sided corrugated paper, for example, corrugated paper material with weights per unit area in the range of roughly 40–400 g/m$^2$. Lightweight material is however desirable. For these purposes it has the special advantage that its adverse effect on the transport costs and disposal costs of the finished packaging is as little as possible.

SUMMARY OF THE INVENTION

The object of the invention is to make available a blank from which scrap-free production of containers is possible; the containers with impact- and compression-stable side walls and compartment partitions can consists of any desirable, also light-weight cardboard and paperboard material, especially corrugated paper web material, and the containers can be folded into shape from the blank in a continuous process as desired. The working processes can be carried out in a system with direct access to the filling system for adding given contents and subsequent ready-for-sale repackaging.

While the initially explained known blanks yield containers of relatively sensitive impact and compression susceptibility, by means of the blanks as claimed in the invention it is possible to improve the stability of the longitudinal sides of the containers. In the useable form of containers as claimed in the invention the side parts as a result of additional inside flap parts thereon are essentially double-layered or triple-layered; at the same time the impact and compressive loading capacity of the compartment partitions can be optimized as claimed in the invention because the partitions are likewise double-layered in the form in which the containers are used. In addition they can be folded as far as the inner bottom of the container so that they can rest on the bottom. Furthermore, the flap parts in the container embodiment as claimed in the invention have a cushioning action and can equalize format irregularities of the piece contents which may be present internally on the compartment sides within comparatively larger tolerances. Secure holding of even piece contents with relatively diverse shapes is reliably guaranteed.

Any known cardboard and paperboard materials can be used as the material for the blanks as claimed in the invention; thick paper can also be used. For economic reasons the material should have a weight as light as possible. The weight per unit area of the material used should preferably be in the range of 40–400 g/m$^2$. If desired, depending on the application, it can be provided with grease- and/or water-repellant coatings. In particular when the containers as claimed in the invention are intended for packaging of food, preferably grease-proof paper and paperboard types are used for the blanks as claimed in the invention.

It is possible to produce and fill containers as claimed in the invention of the corresponding web material directly from the web material roll in a special packaging unit, and—coated with repackaging material if this is desired—to obtain them ready to be shipped or sold.

This ensures good, fresh quality of the packaged goods.

The web material rolls are delivered directly by the corrugated cardboard manufacturer for example to the packaging plant.

Containers as claimed in the invention can be produced in various dimensions and/or compartmentalizations, with and without covers. The containers can, according to the maximum width of the corrugated paper production plant, have at most a length of 2450 mm and can have several, for example, up to 8 individual compartments. For practical purposes containers as claimed in the invention in lengths up to 800 mm and with 2 and 3 individual compartments have proven especially feasible. The individual compartments can be filed with one or more piece items depending on their thickness.

Since the blanks as claimed in the invention are worked entirely without scrap from the web material, the use of the containers as claimed in the invention folded therefrom in the food domain, for pharmaceutical and for cosmetic products, is easily hygienically possible.

BRIEF DESCRIPTION OF THE DRAWINGS

In the following the invention is detailed using certain embodiments shown in the Figures.

DESCRIPTION OF THE PREFERRED EMBODIMENTS

Figure 1:
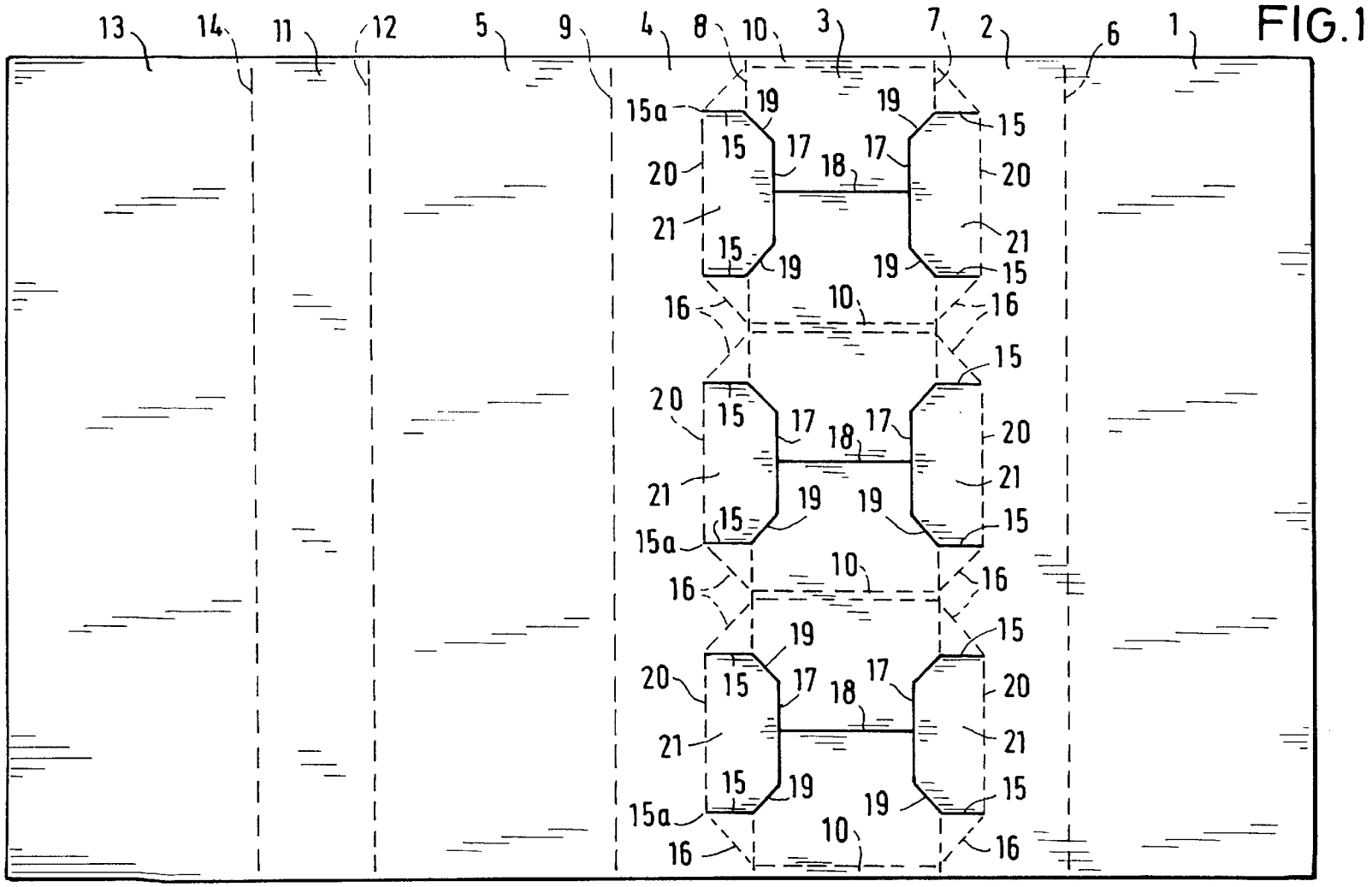
FIG. 1 shows a blank as claimed in the invention in an overhead view.

The blank shown in FIG. 1 comprises seven plate parts; first bottom plate 1 is connected to first side wall plate 2 via longitudinal folding line 6. Plate 2 is connected via longitudinal folding line 7 to intermediate plate 3 and the latter in turn to second side wall plate 4 via longitudinal folding line 8. Second bottom plate 5 is connected to side wall plate 4 via longitudinal folding line 9, and additional side wall part 11 is suspended via longitudinal folding line 12 on bottom plate 5 and additional cover plate part 13 is connected via another longitudinal folding line 14 to side wall part 11.

Intermediate plate part 3 has four transverse folding lines 10, of which each is located on each of the two outer longitudinal edges of the blank. These two outer edge transverse folding lines 10 can, if individual containers which are not shown are to be produced which are to be filled without repacking, be extended in the manner known to one skilled in the art for example from EP 0792893 A2 via side wall plates 2 and 4 and 11 and cover plate 13 and bottom plates 1 and 5, for which then there can be the bilateral longitudinal side end parts, likewise not shown, with the corresponding sections and folds, in the course of each longitudinal folding line and with the corresponding obliquely running folding lines in between which are configured to form end walls.

Figure 2:
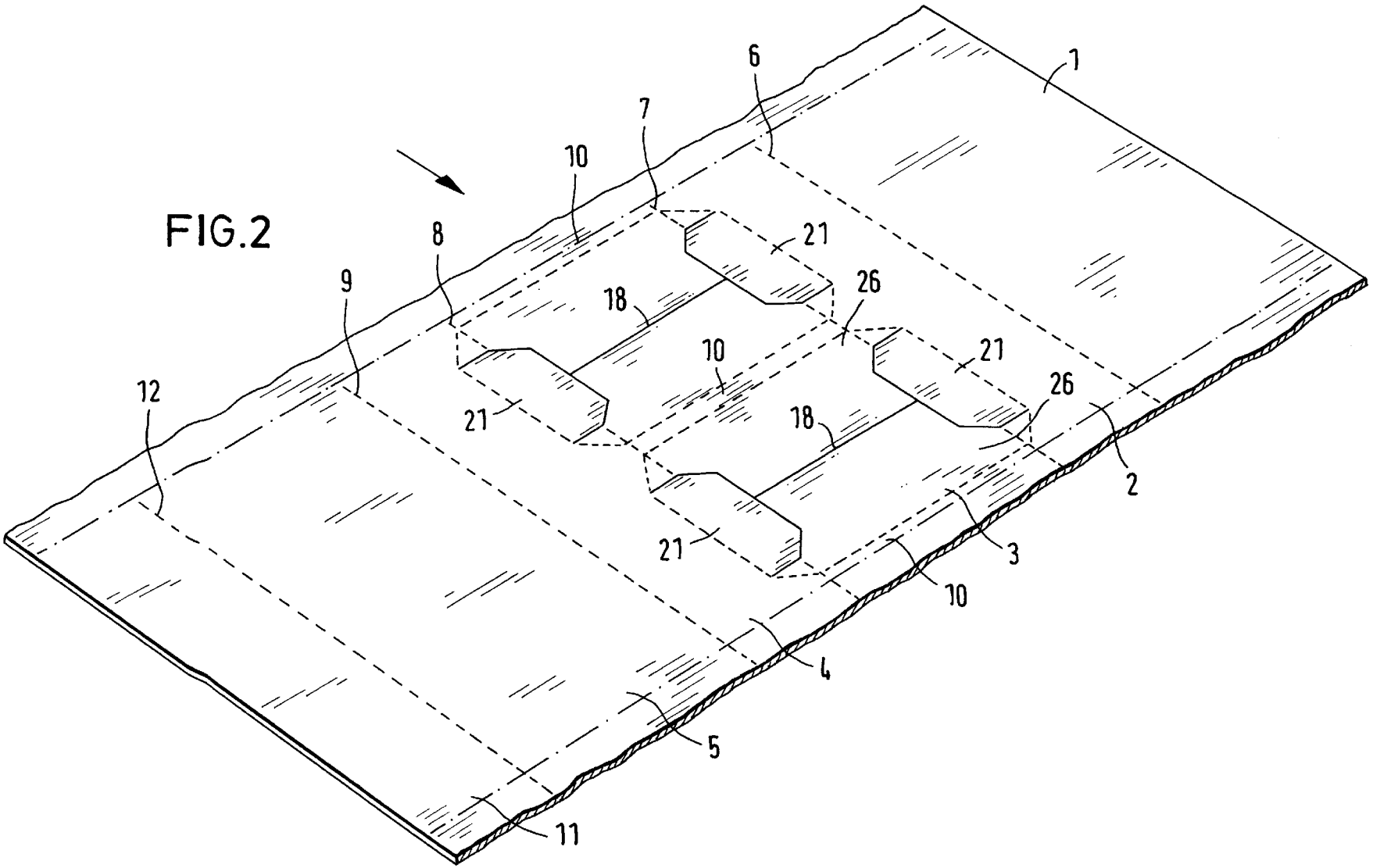
FIG. 2 shows another blank as claimed in the invention.
Figure 3:
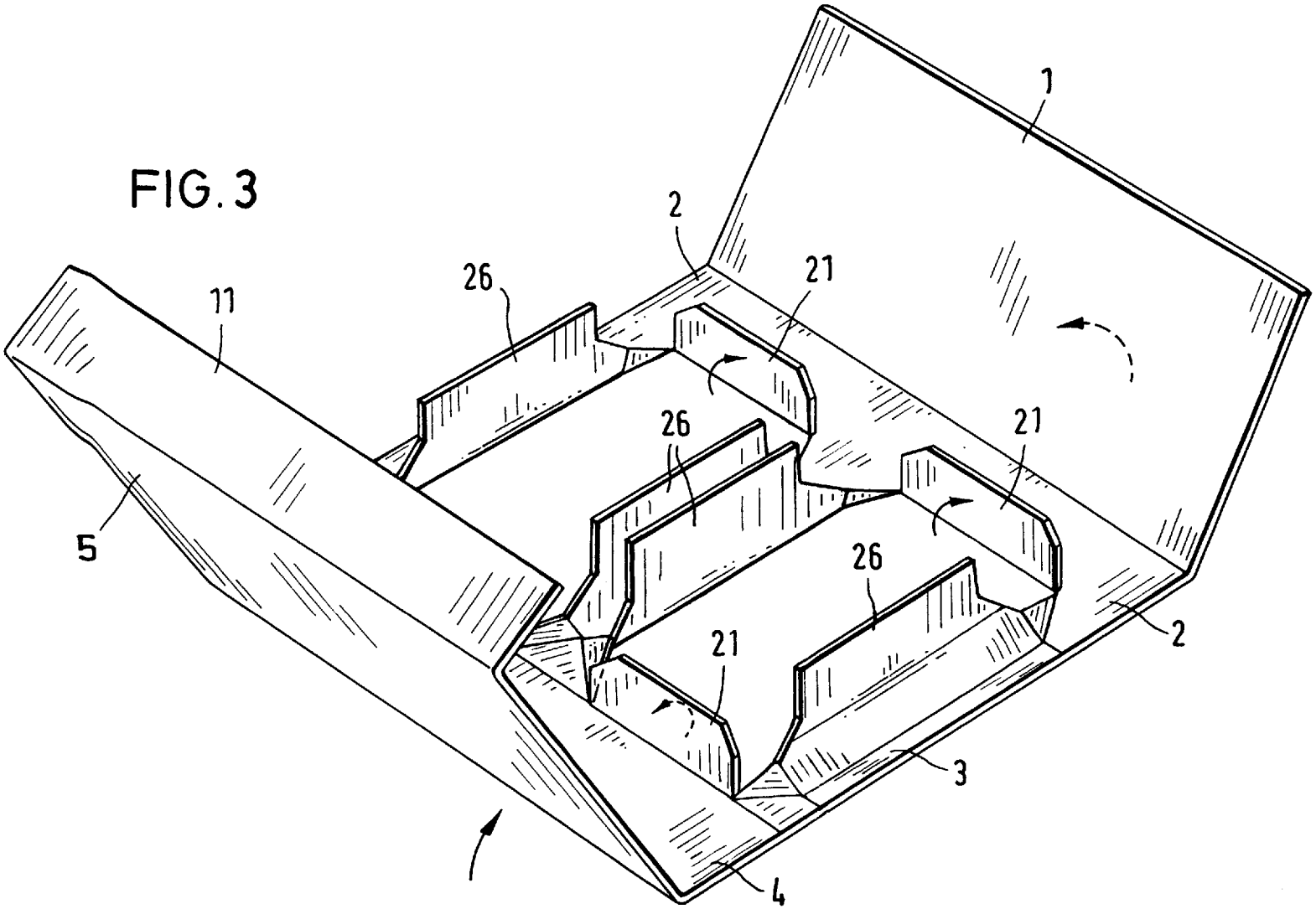
FIG. 3 shows the blank of FIG. 2 in a folding stage, with individual, already assembled parts and in the beginning folding process.
Figure 4:
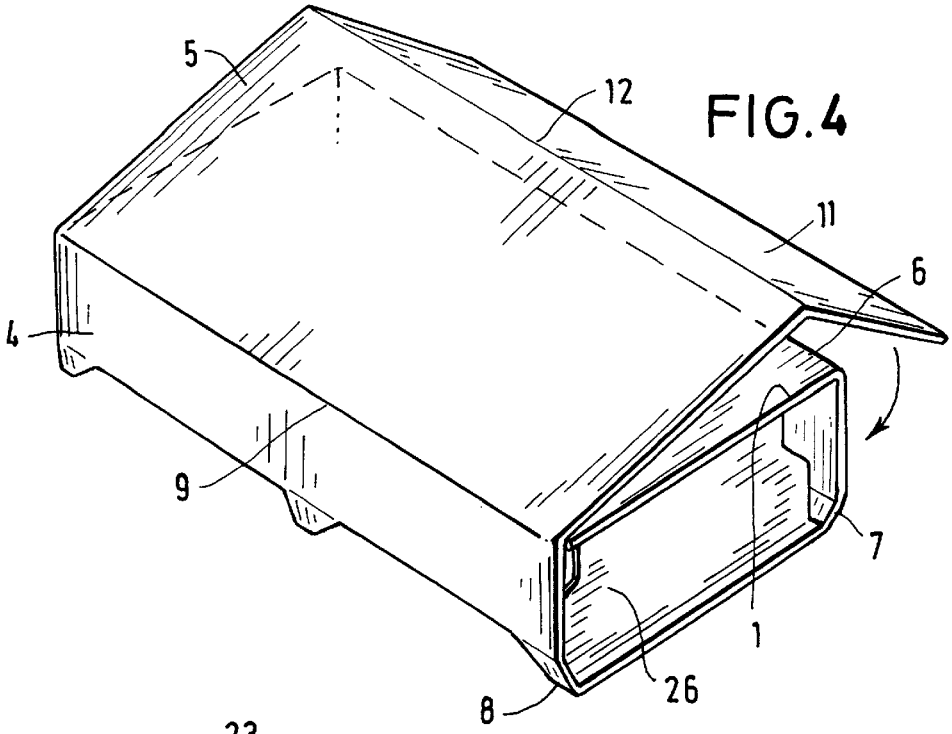
FIG. 4 shows the container resulting from the working stage of FIG. 3 shortly before the end of the folding process and before gluing.

Intermediate plate part 3 furthermore has three sections 18 which run transversely and three each parallel to folding lines 7 and 8 at a certain distance to these longitudinally running additional sections 17 which are cut in the center of sections 18. Second additional sections 19 which run obliquely to longitudinal folding line 7 and 8 and which find their continuation in transversely running third additional sections 15 which run from the intersection of sections 19 with longitudinal folding lines 7 and 8 each as far as end point 15*a* in side parts 2 and 4 join additional sections 17 on their bilateral end points. Between two end points 15*a* which belong to one section sequence 15/19/17/19/15 each there is one each additional longitudinal folding line 20 and it is connected to folding lines 16 which each run obliquely to transverse folding lines 10 and which join end points 15*a*. There are thus limited fields 21 which are made hexagonal, as can be seen especially clearly in FIG. 2 as well. Fields 21 form elastic side flap parts 21*a*, easily recognizable in FIG. 7, when the blank is assembled and folded into container 24—this process is illustrated in steps in FIGS. 2, 3, 4 and 5 on a blank of six plate parts 1, 2, 3, 4, 5, 11 (without the cover part) with five longitudinal folding lines 6, 7, 8, 9 and 12, while rectangular parts 26 which are located between transverse folding lines 10 and transversely running sections 18 with partially cut-out side edges in assembly form partitions 22 of individual compartments 25 in finished container 24. Center transverse folding line 10 in the blank of FIG. 2 is present as a parallel pair of transverse folding lines and accordingly center partition 22 in container 24 assembled from this blank has a crosspiece formation as is apparent from FIGS. 5 and 6.

In the folding process, around longitudinal folding lines 6, 7, 8, 9 and 12 bottom plate part 1 is bent by 90 degrees so that at this point bottom plate part 1 comes to rest over assembled rectangular parts 26 which form separating crosspieces 22, while flap parts 21*a* bent to the inside at the same time around folding line 20 by 180 degrees and the triangular edge parts refolded laterally to the inside around folding lines 16 come to rest on side plate parts 2 and 4 as reinforcement. And furthermore bottom plate part 5 is bent by 90 degrees around longitudinal folding line 9 such that it covers bottom plate part 1 and thus doubles the bottom of container 24, while in addition side wall plate part 11, after it has been at least partially covered with adhesive on its inside surface located near longitudinal folding line 12, is bent by 90 degrees in the form shown in FIG. 4 in longitudinal folding line 12 and is cemented to side wall 2, doubling it from the outside.

Figure 5:
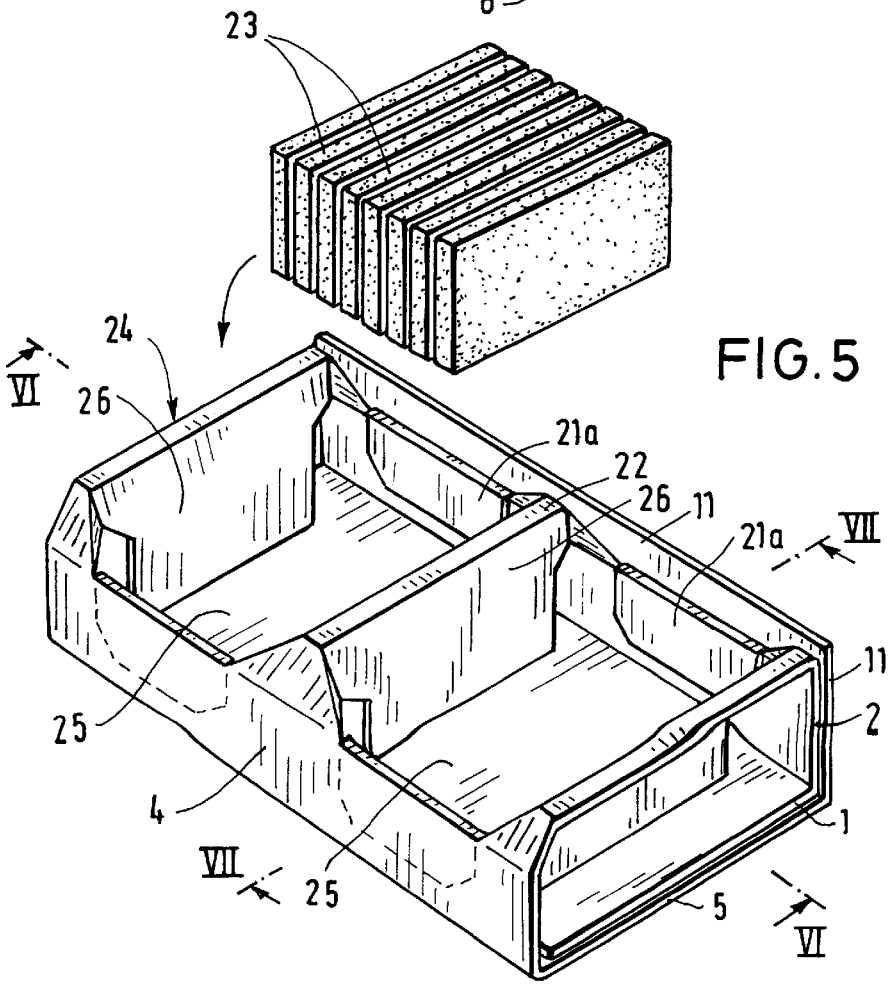
FIG. 5 shows the container of FIG. 4 after gluing and after the turning process in an overhead view: the individual compartments in the container formed by assembly now lie open and can be filled.

After turning of then finished container 24 it has the form shown from FIG. 5 in an overhead view and is ready to be filled with the filler as is illustrated by the arrow in FIG. 5 and the filler body 23 shown above the open container.

Figure 6:
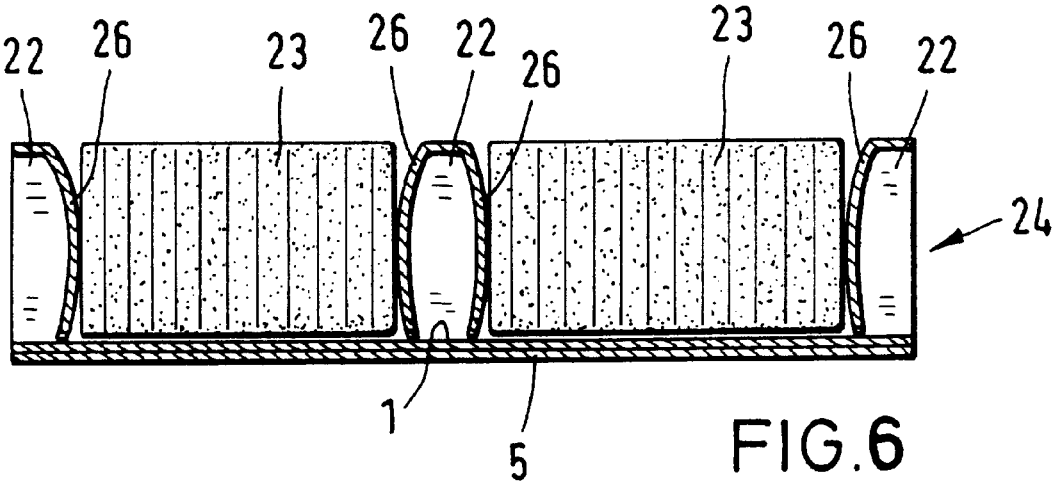
FIG. 6 shows a section as per VI—VI in FIG. 5.
Figure 7:
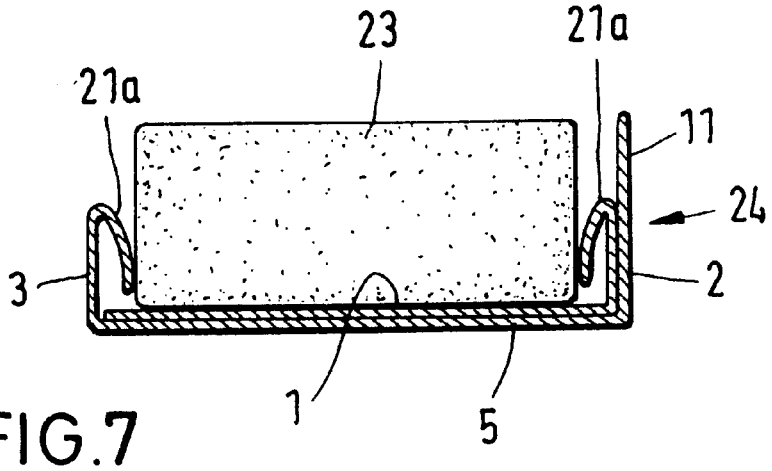
FIG. 7 shows a section as per VII—VII in FIG. 5.

FIG. 6 shows that in the filled state of container 24 the contents 23 are held securely, on the one hand by rectangular parts 26 which form the partitions and which are supported on inner bottom 1 and thus are very stable and have a certain lateral compression effect on the contents (FIG. 6), and on the other hand by elastic side flap parts 21*a* on side wall parts 2 and 4 (FIG. 7).

In the conventional manner the filled container can be wrapped with repackaging, for example, with conventional film packaging which can be printed, transparent or opaque, sealed or otherwise closed in the manner known to one skilled in the art.

Blanks as claimed in the invention can be continuously produced without scrap from web material and continuously folded in the corresponding plants into containers which for their part can be continuously filled when the corresponding plants are set up directly at the manufacturer of the filler.

Containers folded into shape from the blanks as claimed in the invention can be used for packaging of any, especially sensitive piece articles, such as food, for example, cookies, cosmetic products, for example, bath tablets, pharmaceutical products and the like. The contents can be placed in the individual compartments of the containers by hand or mechanically.

Used containers as claimed in the invention are optimally easy to dispose of.

Legend

1 bottom plate part
2 side wall plate part
3 intermediate wall plate part
4 side wall plate part
5 bottom plate part
6 longitudinal folding line (between 1+2)
7 longitudinal folding line (between 2+3)
8 longitudinal folding line (between 3+4)
9 longidudinal folding line (between 4+5)
10 transverse folding lines in 3
11 additional side wall plate part
12 longitudinal folding line (between 5+11)
13 additional cover plate part
14 longitudinal folding line (between 11+13)
15 transversely running third additional sections in 2
15*a* end points of 15
16 obliquely running folding lines of 10 in 2 or 4
17 longitudinally running additonal sections in 3
18 transversely running sections in 3
19 obliquely running second additional sections in 3
20 additonal longitudinal folding lines
21 hexagonally shaped fields
21*a* side flap parts (folded to the inside)

22 partitions
23 filler
24 container
25 individual compartments
26 rectangular parts.

What is claimed is:

1. A blank for producing a finished container which is divided into compartments, comprising:

at least a rectangular first panel joined to a rectangular second and third panel at a first and second fold line, respectively, and a rectangular fourth panel joined to a rectangular fifth panel at a third fold line, said second panel being joined to said fifth panel at a fourth fold line, said fold lines being parallel and extending from a first blank edge to an opposite second blank edge;

said panels being structured and arranged for folding along respective fold lines such that in a folded mode said fifth panel forms one container side, said first panel forms an opposite second container side, said third and fourth panels overlap to form a container bottom, and said second panel forms a container top;

said second panel comprising a plurality of first folding lines and at least one compartment partition, said first folding lines and said compartment partition extending between, and in a direction transverse to, said first and fourth fold lines, at least one compartment partition extending between two first folding lines;

a plurality of first fields formed within said first and second panels, and a plurality of second fields formed within said second and fifth panels;

each first field being formed by a second folding line which extends in said first panel parallel to said first fold line, a first slit which extends in said second panel parallel to said second folding line, a pair of second slits which extend from respective ends of said second folding line, and perpendicular thereto, to said first fold line, and a pair of third slits extending from respective ends of, and at an angle relative to, a respective first slit to a respective end of a respective second slit;

each second field being formed by a third folding line which extends in said fifth panel parallel to said fourth fold line, a fourth slit which extends in said second panel parallel to said third folding line and said first slit, a pair of fifth slits which extend from respective ends of said third folding line and perpendicular thereto, to said fourth fold line, and a pair of sixth slits extending from respective ends of, and at an angle relative to, a respective fourth slit to a respective end of a respective fifth slit;

a seventh slit extending between and perpendicular to said respective first and fourth slits;

said first panel comprising fourth and fifth folding lines extending at an angle from respective ends of said second folding lines to respective first folding lines at said first fold line;

and said fifth panel comprising sixth and seventh folding lines extending at an angle from respective ends of said third folding lines to respective first folding lines at said fourth fold line.

2. The blank according to claim 1, wherein the first panel and the fifth panel have the same width.

3. The blank according to claim 1, wherein the fourth panel comprises at least a first rectangular part joined to a second rectangular part at a fifth fold line, said first rectangular part being wider than said second rectangular part, said fifth fold line being parallel to said third fold line and extending between said first and second blank edges.

4. The blank according to claim 3, wherein the fourth panel comprises a third rectangular part joined to the second rectangular part at a sixth fold line, which is parallel to said fifth fold line.

5. The blank according to claim 1, wherein the second panel comprises parallel pairs of first folding lines.

6. A container produced from the blank according to claim 1.

7. The container according to claim 6, wherein each first field comprises a first field edge adjacent the first slit, and each first field is foldable at said second fold line such that the first field edge is directed towards the container bottom; and each second field comprises a second field edge adjacent the fourth slit, and each second field is foldable at said third folding line such that said second field edge is directed towards the container bottom.

* * * * *